United States Patent [19]

Kamyshnikov et al.

[11] 4,089,532

[45] May 16, 1978

[54] BLOWOUT PREVENTER RAM ASSEMBLY

[76] Inventors: Arkady Ivanovich Kamyshnikov, ulitsa Prazhskaya, 12, kv. 79; Alexandr Isaakovich Rutitsky, ulitsa G. Titova, 38a, kv. 64; Vladimir Mikhailovich Speransky, ulitsa Tarifnaya, 23, kv. 47; Boris Konstantinovich Danin, ulitsa Deputatskaya, 5, kv. 74, all of Volgograd, U.S.S.R.

[21] Appl. No.: 628,423

[22] Filed: Nov. 3, 1975

Related U.S. Application Data

[63] Continuation of Ser. No. 533,838, Dec. 18, 1974, abandoned.

[51] Int. Cl.[2] ..... E21B 33/06

[52] U.S. Cl. ..... 277/129; 251/1 A

[58] Field of Search ..... 166/82, 84, 86, 88; 251/1 R, 1 A, 1 B; 277/73, 126, 127, 129

[56] References Cited

U.S. PATENT DOCUMENTS

| | | | |
|---|---|---|---|
| 1,861,614 | 6/1932 | Schweitzer | 277/129 X |
| 1,963,683 | 6/1934 | Shaffer | 251/1 |
| 2,746,710 | 5/1956 | Jones | 277/126 X |
| 3,434,729 | 3/1969 | Shaffer et al. | 277/73 X |
| 3,572,627 | 3/1971 | Jones | 277/127 X |

*Primary Examiner*—Martin P. Schwadron

*Assistant Examiner*—Richard Gerard

*Attorney, Agent, or Firm*—Holman & Stern

[57] ABSTRACT

A blowout preventer ram assembly adapted to seal the mouth of the hole of oil and gas wells in the process of their drilling. The ram assembly incorporates two rams, each of which comprises a ram rubber constituted by two arcuate members of larger and smaller radii, and a ram block provided with a projection is placed in the gap therebetween. The ram rubber is reinforced on the end faces by control members each of which consists of two parts. The first part is defined by two rigidly interconnected plates arranged in the arcuate member of the ram rubber of a smaller radius. One face of each plate has a radius corresponding to that of the largest pipe of the set of pipes to be sealed, while a second face is arranged parallel to the end face of the ram rubber, and a third face is arranged at an angle to the first face and is in contact with the ram block. The second part of the control member of the ram rubber is arranged in the arcuate member of a larger radius and has a guide for this part to move in a direction normal to the end face of the ram rubber. A cavity is provided between the arcuate member of the ram rubber of a smaller radius and the ram block, while on the inner surface of the ram holder, within the area of control members of the ram rubber, provision is made for grooves into which part of the ram rubber is displaced in the process of pipe sealing.

8 Claims, 10 Drawing Figures

BLOWOUT PREVENTER RAM ASSEMBLY

This is a continuation of application Ser. No. 533,838, filed Dec. 18, 1974, now abandoned.

BACKGROUND OF THE INVENTION

The present invention relates generally to equipment or apparatus designed for drilling oil and gas wells and, more specifically, for blowout preventer ram assemblies adapted for sealing-off the mouth of holes in the process of drilling.

PRIOR ART

The blowout preventers hitherto used fall, according to their design and performance features, into ram-type preventers provided with packing elements for each pipe size and annular preventers with packing elements for operation with drill pipes of a number of sizes.

The ram blowout preventers are incorporated as a principal working member adapted for direct sealing-off of the mouth of hole, the ram assembly consisting of two identical ram sub-assemblies accommodated within the rectangular chamber of the blowout preventer body. The movement of the rams in the chamber towards the center and backwards is carried out in the known devices by means of hydraulic cylinders with the chamber walls serving as guides for the ram assembly. Sealing of the ram assembly and the blowout preventer is effected in the upper plane of the chamber.

The rams of the blowout preventer are essentially the holder with the resilient ram rubber and the ram block fixed in position thereon. There are known rams in which the ram block and the holder are integral.

The ram rubber is, in fact, a resilient tough-rubber piece with embedded rigid rubber flow-control members to strengthen the most responsible components of the ram assembly. These members are steel plates with a recess whose radius equals that of the pipe to be sealed. The plates are fixed on the upper and lower surfaces of the ram rubber so as to preclude the rubber from being forced out along the axis of the pipe to be sealed and to contribute to the rubber to be displaced towards the pipe seal area.

When moving towards the center of the pipe to be sealed, the rams come into contact by their end faces and seal the pipe, thereby making the latter hermetically sealed.

To ensure sealing of the pipe of another diameter, the recess in the reinforcing steel plates of the ram rubber are of the same diameter which practically demands replacement of the rams or the provision at the mouth of the hole of a number of blowout preventers with the rams to suit the diameters of the pipes to be sealed.

To provide sealing a plurality of drill pipes with the same ram rubber, annular blowout preventers have been developed.

An annular blowout preventer incorporates a body which accommodates a massive packer of a flexible material provided with rigid reinforcing members and a mechanism to move the packer to the pipe to be sealed.

When the packer moves, it can be deformed, so that the drive of the blowout preventer is designed to develop greater forces which are to rise as the body bore and the working pressure of the annular blowout preventer rise.

In addition, in the process of movement of the packer towards the pipe to be sealed, the material from which the packer is made, is displaced towards the center, with the result that some portions of the rubber are found to be unprotected by the control members. To preclude the rubber from being forced out on the above-mentioned portions, the ram rubber thickness is substantially increased. This leads to increased overall dimensions, weight and cost of the annular blowout preventers which will make the same impractical.

There are known attempts aimed at a modification of annular blowout preventers which failed to substantially improve specifications and reduce the cost of the preventers in question.

According to the foregoing, it has become reasonable to provide such a ram assembly that, without any substantial modification of the known ram blowout preventers, would make it possible to seal pipes of different sizes.

OBJECTS AND SUMMARY OF THE INVENTION

It is a general object of the present invention to provide a ram assembly for a blowout preventer which makes the sealing of pipes of different size possible without replacement of the components thereof.

It is another object of the present invention to provide a blowout preventer ram assembly which makes it applicable to the presently existing blowout preventers without substantial modification of the design and overall dimensions thereof.

It is still another object of the present invention to provide a ram assembly for a blowout preventer which is simple in design, inexpensive to manufacture and reliable in operation.

These and other objects of the present invention are accomplished in that a blowout preventer ram assembly comprises two identical rams, each of which includes a resilient rubber with rubber-flow control members, a ram block and a holder.

The resilient rubber is defined by arcuate members of larger and smaller radii spaced by a gap and interconnected at their end faces by a connecting piece. The ram block is positioned in the gap and is provided with a projection overhanging the arcuate member of smaller radius. The holder encloses both the rubber and the ram block.

The rubber-flow control members are disposed in the end faces and connecting pieces in the zone where they are connected. Each control member is constituted by first and second conjugated parts, with the first of the parts being fixed on the surface of the arcuate member of smaller radius facing the projection of the ram part. The first part is a plate, one face of which is parallel to the end face of the rubber connecting piece, while a second face of the plate facing the pipe being sealed is arcuate and a third face of the plate facing the ram block is located at an angle to the first of the plate faces. A portion of the ram block contacts the third face of the plate and is inclined at the same angle to the first plate of the face.

The second of the parts is secured in the end face of the arcuate member of larger radius and is provided with a guide enabling such part to move in a direction perpendicular to the end face of the ram rubber.

It is highly expedient that the portion of the arcuate rubber member of smaller radius, which is positioned between the rubber-flow control members of the ram rubber on the side of the ram block projection be thin and that the thin portion of the ram rubber on the side of the pipe being sealed protrudes in a radial direction relative to the projection which forms a cavity with the thin portion of the ram rubber. The inner surface of the holder, in the zone of the rubber-flow control members, preferably is provided with slots and the height of the ram rubber member of larger radius in the zones of the slots increased with respect to the other portions of such ram rubber member. The volume of the cavities and the slots is selected dependent upon the quantity of the packing material to be displaced to the cavities and slots when the smallest diameter pipe of the set of pipes to be sealed is being sealed.

One of the embodiments may feature a ram block provided with an additional projection with both said ram block projections embracing the arcuate member of a smaller radius, while said first reinforcing part may be provided with an additional plate which is identical to said first plate, with both said plates arranged within the area of the connecting piece of said ram rubber on the surface of said ram rubber arcuate member of a smaller radius, with said surface facing said ram block projections.

In some embodiments, said plate may be rigidly interconnected.

The second part of the ram rubber control member is essentially a bracket whose end face portions, contacting the ram block, are oriented normal to the end face of the ram rubber, with the first part of the ram rubber control member being located therebetween, while the ends of the bracket are provided with pins arranged parallel to the end face of the ram rubber and being in contact with the ram holder.

Other objects and advantages of the present invention will be more apparent from the detailed description of the embodiments thereof with due reference to the accompanying drawings, wherein:

DETAILED DESCRIPTION OF THE INVENTION

Figures 1, 2, 3, 4, 5, 6:
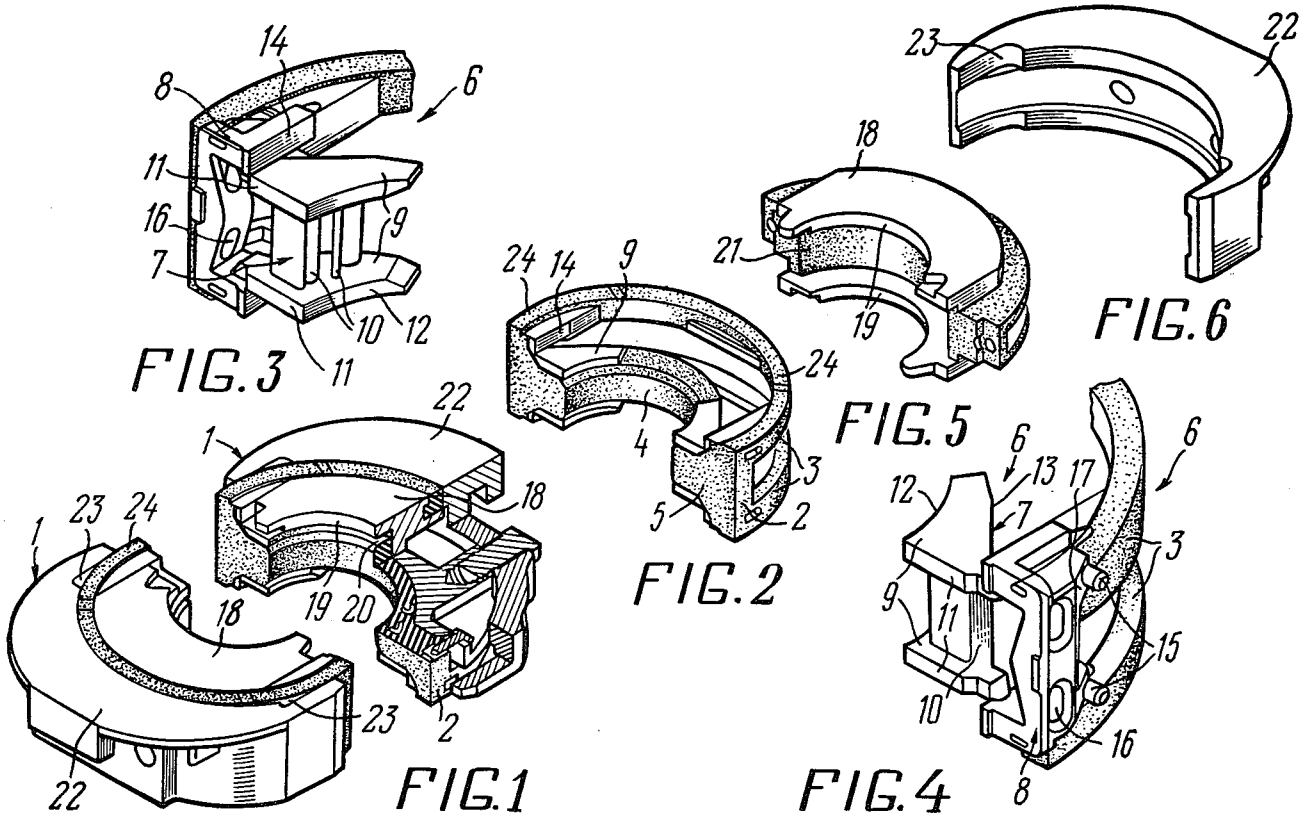
FIG. 1 is a view of a blowout preventer ram assembly partly broken away and in elevation and section according to the invention.
FIGS. 2, 3, 4, 5 and 6 are perspective views of structural members of the ram.

Referring to FIGS. 1 and 2, the ram assembly incorporates essentially two identical rams 1, each of which incorporates a ram rubber 2 of a resilient material, say, rubber. The ram rubber 2 is, in fact, arc-shaped members 3 and 4 of larger and smaller radii, respectively, which with their end faces are interconnected by a connecting piece 5. The members 3 and 4 and the connecting piece 5 at the point of connection are reinforced by two rigid members 6 of a robust material, say, of steel. Each member is defined by two conjugated parts 7 and 8 (FIGS. 3, 4). The conjugated portion is provided with a gap filled with rubber tightly connected to said members 7, 8 and being an integral part with the ram rubber 2; such an arrangement of the parts provides for their mutual and simultaneous displacement in a direction normal to the ram rubber end face.

The member 7 is composed essentially of two plates 9 fixed in position on the upper and lower surfaces of the member 4 of the ram rubber 2 within the area of the connecting piece 5. The plates 9 are interconnected by a rigid connecting piece 10. When, during operation of the blowout preventer, its rams are oriented permanently, i.e., the upper plane of the ram rubber 2 faces outwards with respect to the well and the lower plane faces inwards, then the member 7 may be a single plate 9 located on the upper plane of the arcuate member 4.

A face 11 of the plate 9 is arranged parallel to the end face of the ram rubber 2, while a face 12, facing the pipe to be sealed, is arcuate and features a radius equal to that of the largest-diameter pipe to be sealed, and a third face 13 of the plate 9 is arranged at an angle to the face 11 (preferably at 45°).

The second part of the control member 8 of the ram rubber 2 is fixed in position in the end face portion of the member 3 of the ram rubber 2 and is in fact a bracket. The plates 9 are arranged between end face portions 14 of the bracket ends and are perpendicular to the end face of the ram rubber. On the opposite side, as viewed from the portions 14, the bracket is provided with pins 15 oriented parallel to the end face of the ram rubber 2. The portions 14 and the pins 15 of the member 8 serve as guides for the member 8 to move in a direction normal to the end face of the ram rubber 2. To ensure proper adhesion of the member 8 and the ram rubber 2, the member 8 is provided with holes 16 and bevel edges 17.

Located in the gap between the arcuate members 3, 4 of the ram rubber 2 is a ram block 18 (FIGS. 5, 6) together with a projection 19 which embrace the member 4 of the ram rubber 2. The end face of the projection 19 facing the pipe to be sealed, is arcuate and has a radius equal to that of the greatest-diameter pipe of the set of pipes to be sealed.

Figure 7:
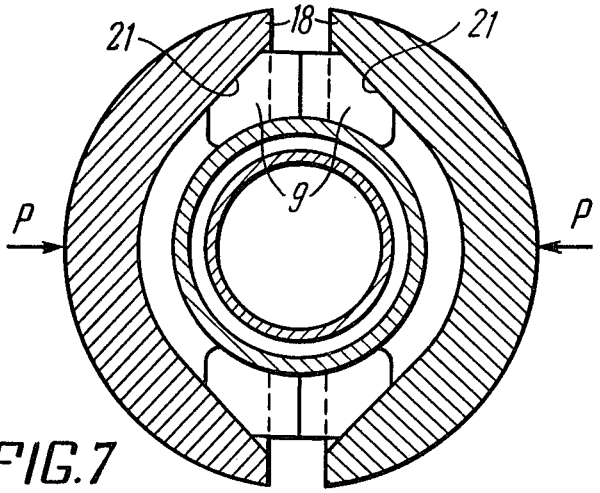
FIG. 7 is a view in section and illustrates control members shown in the position in which the largest-diameter pipe is to be sealed.
Figure 8:
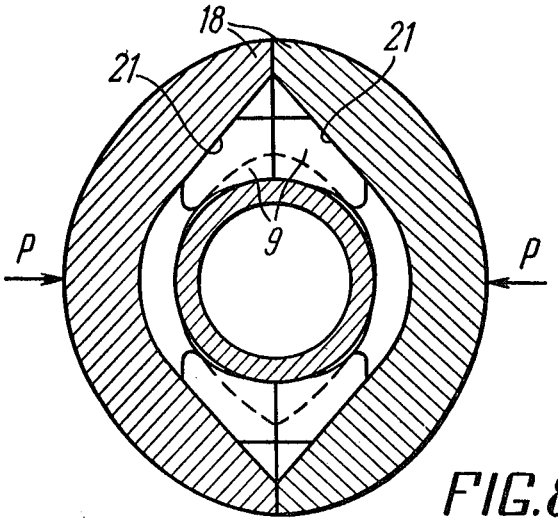
FIG. 8 is a view in section and illustrates control members shown in the position in which the smallest-diameter pipe is to be sealed.

The middle portion of the arcuate member 4 between the members 6 of the ram rubber 2 define together with the projection 19 of the ram block 18, a cavity 20 (FIG. 1). A portion of the ram rubber 2 protrudes in a radial direction with respect to the projection 19 by a distance sufficient to ensure the required contact pressure to close-off the pipes. The ram block 18 features portions 21 (FIGS. 5, 7, 8) which are in contact with the faces 13 of the plates 9, with the angle of inclination of the portions 21 and the faces 13 to the end face of the ram rubber 2 being identical.

The ram rubber 2, assembled with the ram block 18, is enclosed in a holder 22 (FIGS. 1, 6) of the ram assembly 1, which embraces the ram rubber 2 on the side of the member 3 of the ram rubber 2. The inner surface of the holder 22 at which the control members 7, 8 of the ram rubber 2 are located is provided with slots 23. One of the walls of each slot features its surface normal to the end face of the ram rubber 2 and is in contact with the pin 15 of the member 8.

Figure 9A:
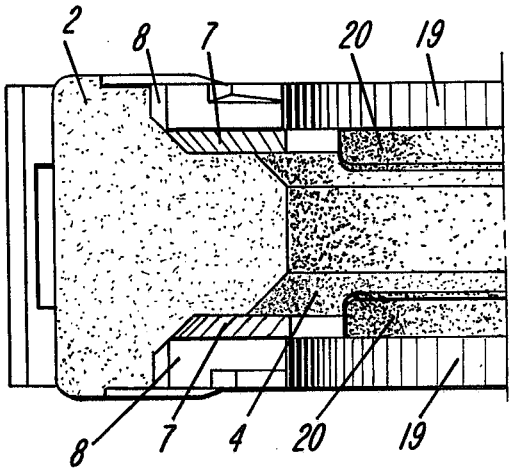
FIGS. 9*a* and 9*b* are enlarged, fragmentary elevations showing details of seal assemblies.
Figure 9B:
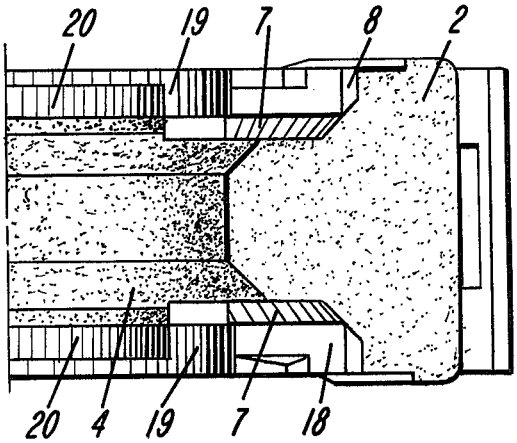

The space of the cavity 20 and that of the slots 23 is selected depending on the amount of packing material which is to be displaced into said cavity 20 and said slots 23, when the smallest-diameter pipe from the set of pipes to be sealed is being sealed. Moreover, the cavity 20 may be formed by a slot provided in the ram block 18 on its surface facing the arcuate member 4 of the ram rubber 2 or said cavity 20 may be formed in the body of the member 4; see FIGS. 9*a* and 9*b*.

Provision is made within the area of the slots 23 on the upper and lower surfaces of the member 3, for an excess amount of the rubber which forms protrusions 24. Thus, the height of the member 3 within the area of the slots 23 is increased as compared to the height of the remaining portion of the member 3.

The height of the protrusion 24 is selected to ensure the contact pressure required to seal the ram assembly and the blowout preventer body (not shown in the drawing).

As a drive to displace the rams 1 of the blowout preventer, use may be made of, say, hydraulic cylinders (not shown in the drawing).

When sealing the largest diameter pipe of the set of pipes to be sealed, the ram assembly operate as follows:

Operation of the drive causes the rams 1 to displace within the body (not shown in the drawing) of the blowout preventer towards the pipe to be sealed in the direction indicated by arrows P (FIG. 7), with the result that the rams 1 are made contacting with their end faces and are pressed to the pipe with the surface of the member 4 of the ram rubber 2. The rubber of the arcuate member 3 due to its being pressed between the surfaces of the ram block 18 and the holder 22 is forced out to contact with the respective surface of the blowout preventer body.

Sealing of the ram assembly in the area of the slots 23 is ensured by means of the protrusions 24 of the ram rubber 2, while within the cavities 20 it is attained due to the fact that the member 4 protrudes with respect to the projections 19 of the ram block 18. Displacement of the rubber of the member 4 along the axis of the pipe to be sealed is prevented by the plates 9, which reinforce the ram rubber 2, and by the projections 19.

The portions 14 and the pins 15 of the reinforcing member 8 of the ram rubber 2, which are in contact with the portions 21 of the ram block 18 and the slots 23 of the holder 22 of the ram assembly 1, respectively preclude the member 8 from turning with respect to the end face of the ram rubber 2, and, consequently, to force the rubber out of the member 3 in a direction normal to the axis of the pipe to be sealed.

Due to the fact that the faces 12 of the plates 9 and the end face of the projection 19 have a radius equal to that of the largest-diameter pipe of the set of pipes to be sealed, there is no substantial displacement of the members 7 and 8 with respect to each other.

When a smaller-diameter pipe is to be sealed, including the smallest-diameter pipe of the set of pipes to be sealed, the ram assembly operates as follows:

The rams 1, moving in the direction P (FIG. 8), first come into contact to each other by their end faces 5, and a gap equal to the difference in the diameters of the largest pipe and of that to be sealed is formed between the arcuate members 4 of the ram rubber 2 and the pipe.

The forces compressing the rams 1 from their end faces, are imparted to the control members 7 of the ram rubber 2, thereby causing the latter to slide along the portions 21 of the ram block 18 with the result that the members 7 are displaced towards the pipe center until the arcuate members 4 of the ram rubber 2 come into contact with the surface of the pipe to be sealed.

Concurrently with the movement of the control members 7 of the ram rubber 2, the members 8 move in a direction perpendicular to the plane of the end face of the ram rubber 2, with the portion 14 and the pins 15 of the members 8 sliding over respective surfaces of the ram block 18 and the holder 22 of the ram 1.

When the control members 7, 8 of the ram rubber 2 move, the portions of the ram rubber associated with said members 7, 8 are entrained. The cavities 20 and the slots 23 are provided at the points to which the rubber entrained by the members 7 and 8 is moved. The space of the cavities 20 and that of the slots 23 depends on the amount of the rubber displaced to said cavities 20 and said slots 23, when the smallest-diameter pipe of the set of pipes to be sealed is being sealed.

The provision of the cavities 20 and slots 23 ensures the required contact pressure over all the surfaces to be sealed, and, besides, the cavities 20 provide for a minimum possible gap between the pipe being sealed and the ram block 18 which is especially important for the high-pressure blowout preventers.

This invention is not to be confined to any strict conformity to the drawings but changes or modifications may be made provided such modifications mark no material departure from the spirit and scope of the appended claims.

What we claim is:

1. A blowout preventer ram assembly defined by two identical rams, each ram comprising: a resilient ram rubber constituted by arcuate members of larger and smaller radii, said arcuate members being mounted with a gap therebetween and being interconnected with their end faces by a connecting piece disposed in a plane perpendicular to the direction of ram movement; a ram block arranged in said gap and provided with a projection hanging over said arcuate member of smaller radius; a holder, said holder embracing said ram rubber together with the ram block; rigid rubber-flow control members arranged in said end faces of the ram rubber and the connecting pieces, wherein the same are connected, each of said latter members being constituted by first and second conjugated parts; the first of said conjugated parts being fixed in position on the surface of said arcuate member of smaller radius, facing said projection of the ram block and being a plate having one face parallel to the end face of connecting piece of said ram rubber, a second face of said plate, facing the pipe to be sealed, and being arc-shaped, and a third face of said plate facing said ram block, and being arranged at an angle to said first plate face, with a portion of said ram block being in contact with said third face of the plate and inclined at the same angle with respect to said first face of the plate for sliding camming engagement by said ram block upon movement of the ram to a pipe engaging position; the second of said conjugated parts fixed in position in the end face of said arcuate member of larger radius and having a guide for said second part to move in a direction normal to said end face of the ram rubber.

2. The blowout preventer ram assembly as claimed in claim 1 wherein said arcuate face of the plate has a radius corresponding to that of the largest diameter pipe of the set of pipes to be sealed.

3. The blowout preventer ram assembly, as claimed in claim 1, wherein the portion of the arcuate member of smaller radius, arranged between the control members of said ram rubber on the side of the ram block projection is a portion of said ram rubber on the side of the pipe to be sealed and protrudes in a radial direction with respect to said projection, thus defining a cavity together with said projection, and on the inner surface of the holder, in which said control members of ram rubber are arranged, provision is made for slots, and the height of the ram rubber member of greater radius within the area of said slots is increased as compared to the remaining portion of said ram rubber member, with the space of said cavity and the slots being selected depending on the amount of the material of the ram rubber displaced to said cavity and said slots when the smallest-diameter pipe of the set of pipes to be sealed is being sealed.

4. The blowout preventer ram assembly as claimed in claim 3, wherein said cavity is formed by a slot made in the ram block on the surface thereof facing the arcuate ram rubber member of smaller diameter.

5. The blowout preventer ram assembly as claimed in claim 3, wherein said cavity is provided in the arcuate ram rubber member of smaller diameter.

6. The blowout preventer ram assembly, as claimed in claim 1, wherein the ram block is provided with an additional projection and both said projections of the ram block embrace the arcuate member of the ram rubber of smaller radius, while said first part of the control member is provided with an additional plate identical to said first plate, with both said plates being arranged within the area of the connecting piece of said ram rubber on the surface of the arcuate member of smaller radius, facing an associated projection of the ram block.

7. The blowout preventer ram assembly as claimed in claim 6, wherein said plates are rigidly interconnected.

8. The blowout preventer ram assembly as claimed in claim 1, wherein the second part of the control member of the ram rubber is constituted by a bracket whose end face portions contacting the ram block are oriented normal to the end faces of the ram rubber and the first part of the control member of the ram rubber is arranged therebetween, with the ends of the bracket being provided with pins arranged parallel to the end face of the ram rubber and making contact with the ram holder.

* * * * *